US005248799A

United States Patent [19]

Schmutzler

[11] Patent Number: 5,248,799

[45] Date of Patent: Sep. 28, 1993

[54] PROCESS FOR REFINING GLYCERIDE OIL

[75] Inventor: Luis O. F. Schmutzler, Valinhos, Brazil

[73] Assignee: Unilever Patent Holdings B.V., Rotterdam, Netherlands

[21] Appl. No.: 765,176

[22] Filed: Sep. 25, 1991

[30] Foreign Application Priority Data

Sep. 25, 1990 [EP] European Pat. Off. ..... 90202540.2

[51] Int. Cl.[5] ..... C11B 3/04; C11B 3/10

[52] U.S. Cl. ..... 554/192; 554/191

[58] Field of Search ..... 260/428, 428.5; 554/191, 192

[56] References Cited

U.S. PATENT DOCUMENTS 4,629,588 12/1986 Welsh et al. ..... 554/174

5,069,829 12/1991 Van Dalen et al. ..... 260/428

FOREIGN PATENT DOCUMENTS 195991 10/1986 European Pat. Off. .

247411 12/1987 European Pat. Off. .

376406 7/1990 European Pat. Off. .

OTHER PUBLICATIONS

Derwent Abstract of SU 999,564, Arutgungan et al, 1983.

World Patents Index Latest, Section Ch, Week 8348, Derwent Publications Ltd., London, GB; Class D, AN 83-831665 & SU-A-992 564 (Krasd. Poly.) 30 Jan. 1983 *abstract*.

World Patents Index Latest, Section Ch, Week 8147, Derwent Publications Ltd., London, GB; Class D, AN 81-86846D & SU-A-806 750 (Krasd. Poly.) 25 Feb. 1981 *abstract*.

*Primary Examiner*—José G. Dees

*Assistant Examiner*—D. D. Carr

*Attorney, Agent, or Firm*—Cushman, Darby & Cushman

[57] ABSTRACT

The invention relates to a method for refining glyceride oil, comprising the steps of:

i) acidifying the oil with an acid;

ii) partially neutralizing the acidified oil with alkali;

iii) contacting the partially neutralized oil with an amorphous silica; and iv) removing solids from the glyceride oil.

Preferably, water is removed from the mixture comprising the glyceride oil and the amorphous silica before any solids are removed.

18 Claims, No Drawings

PROCESS FOR REFINING GLYCERIDE OIL

BACKGROUND OF THE INVENTION

1. Field of the Invention

The present invention relates to a process for refining glyceride oil, and in particular to a refining process in which glyceride oil is treated with an acid and alkali, and contacted with a amorphous silica, followed by slowly drying of the mixture comprising the glyceride oil and the amorphous silica.

2. Description of the Prior Art

Glyceride oils from vegetable or animal origin, such as soybean oil, rapeseed oil, sunflower oil, cotton seed oil and the like, are valuable raw materials for the food industry, but it is understood that refined oils of which the end use is non-edible, are also included. These oils in good form are usually obtained from seeds and beans by pressing and/or solvent extraction.

Such crude glyceride oil mainly consists of triglycerides components. However, they generally contain also a significant amount of non-triglyceride components, including phosphatides (gums), waxy substances, partial glycerides, free fatty acids, coloring materials, oxidized compounds and small amounts of metals which are thought to be associated with the phosphatides. Depending on the intended use of the oil, many of these impurities have an undesired effect on the quality, such as taste (stability) and colour of the latter products. It is therefore necessary to refine the crude glyceride oil, i.e. to remove the phosphatides and the other impurities.

In general the first step in the refining process for glyceride oils is the so-called degumming step, i.e. the removal of among other things the phosphatides. In a conventional degumming process water is added to the crude glyceride oil in order to hydrate the phosphatides, which are subsequently removed e.g. by centrifugal separation. Since the resulting water degummed glyceride oil often still contains unacceptably high levels of "non-hydratable" phosphatides, this water degumming step is normally followed by chemical treatments with acid and/or alkali to remove these residual phosphatides and to neutralize the free fatty acids (alkali-refining). Subsequently the soapstock formed is separated from the neutralized oil by e.g. centrifugal separation. The resulting oil is then further refined using bleaching and deodorization treatments.

U.S. Pat. No. 4,049,686 discloses a refining process in which the crude or water degummed glyceride oil is treated with a concentrated acid such as citric acid, phosphoric acid or acetic anhydride, and finally with water, whereby residual phosphorous levels are brought down to within the range of from 20–50 ppm.

The lower the amount of residual phosphatides after the degumming step, the better or easier the subsequent refining steps. Even it may be possible to avoid the alkali refining step all together. A refining process sequence which does not involve an alkali treatment and subsequent removal of soapstock is often referred to as physical refining and is highly desirable in terms of processing simplicity and yield.

The removal of phosphatides from glyceride oils using physical process steps in addition to conventional chemical processes is disclosed in the prior art.

U.S. Pat. No. 4,629,588 discloses for the removal of phosphatides and associated trace contaminants from glyceride oil the use of amorphous silicas, such as silica-gels, silica hydrogels, precipitated silicas, dialytic silicas and fumed silicas.

EP-A-361 622 discloses the use of precipitated, amorphous silicas for the removal of impurities, particularly phosphatides and metals, from glyceride oil.

EP-A-195 991 discloses a process for producing degummed vegetable oils, in which water degummed oil is first subjected to an acid treatment in which acid is finely dispersed in the water degummed oil under specific dispersion conditions, namely 10 million acid droplets or more per gram oil and an interface between the acid droplets and the oil of at least 0.2 $m^2$ per 100 gram of oil, and second to an alkali treatment in which such a quantity of alkali is added to the acid-in-oil dispersion that the pH is increased to above 2.5. The refining process is carried out at an oil temperature of more than 75° C.

This known refining process possesses separation problems reflected in a large number of centrifuges required (EP-A-344 718). For certain oil qualities still too high residual phosphorous contents are obtained.

The invention has for its object to provide a novel refining process for glyceride oil for the removal of impurities such as phosphatides, metals, oxidized materials and soaps, which could be performed at lower operational costs and resulting in the production of less effluents, such as sludges and soapstock.

SUMMARY OF THE INVENTION

This is obtained with the method according to the invention for refining glyceride oils, comprising the steps of:

i) i)acidifying the oil with an acid;

ii) partially neutralizing the acidified oil with alkali;

iii) contacting the partially neutralized oil with an amorphous silica; and iv) removing solids from the glyceride oil.

The starting glyceride oil may be crude or partially degummed. Examples of glyceride oils that may be refined with the method according to the invention are soybean oil, rapeseed oil, sunflower oil, safflower oil, corn oil, cotton seed oil and rice bran oil.

The acid used for acidifying the oil should be an acid which complexes metal ions resulting from the decomposition of metal containing compounds in the glyceride oil. The acid may be inorganic, such as phosphoric acid, or organic, such as citric acid.

Optimal results are obtained if during the acid treatment the temperature is as low as possible, generally less than 60° C., in practice, the oil temperature during acidification is about 10°–50° C., preferably 20°–40° C. The acid should be added at high concentration and under high stirring for homogeneously dispersing the acid through the oil. The amount of acid used depends on the quality of the oil to be refined and an amount of 0.05–2% w/w, preferably 0.15–0.5% w/w is sufficient. In practice, using citric acid 0.7% w/w of 50% w/w concentration is enough for glyceride oils comprising up to 250 mg/kg phosphorous in phosphorous containing compounds.

After the acid treatment the acidified oil is partially neutralized with an alkali. The degree of neutralization is essential, and should be less than 90% of the acid added during the acid treatment. Preferably, the degree of neutralization is less than 80% of the added acid. In practice, optimal results are obtained if the degree of neutralization lies within the range of about 50 to about 75% of the added acid.

Generally, any alkali might be used for the partial neutralization of the acid added during the acid treatment. However, optimal results are obtained if the alkali is selected from the group comprising hydroxides, such as sodium and potassium hydroxide, and further silicates, such as sodium and potassium silicates. The best results are obtained if the alkali is sodium silicate.

Preferably, the alkali is added in the form of an aqueous solution. Optimal results are obtained if the alkali is added in a 10% by weight aqueous solution. During the alkali treatment the oil temperature should also be as low as possible in order to avoid redissolution of the phosphatides into the glyceride oil, and further to minimize the soap formation, generally about 300 to 800 mg/kg soap is formed. It is advantageous when the oil temperature during the acid treatment and alkali treatment are comparable. Accordingly, during the alkali treatment the oil temperature is within the range of about 5° to 60° C.

After the partial neutralization of the oil with alkali, the oil is contacted with an amorphous silica. This amorphous silica may be selected from silica gels, silica hydrogels, precipitated silicas, dialytic silicas and fumed silicas. Examples of these silicas are disclosed in U.S. Pat. No. 4,629,588 and EP-A-361 622. Optimal results are obtained if as amorphous silica a silica hydrogel is used. Before, during or after the addition of the amorphous silica to the partially neutralized oil, the temperature should be raised above 70° C., preferably above 80° C. In practice, the temperature is in the range of about 85° to 95° C.

In order to maximize the amount of impurities which is adsorbed or absorbed by the amorphous silica, water is removed from the mixture comprising the partially neutralized oil and the amorphous silica. Water should be removed slowly to allow gradual substitution of a substantial part of the water residing inside the pores of the amorphous silica by the impurities predominantly comprising soap and hydrated phosphatides. Preferably, the vacuum is below 700 to 400 mbar. In order to avoid excessive froth formation, the vacuum may be gradually increased to below about 150 to 100 mbar.

Preferably, the partially neutralized oil is first contacted with the amorphous silica for for instance 10–40 minutes at a temperature of about 80°–95° C. using about 1% by weight amorphous silica, depending on the oil quality. Thereafter, the mixture comprising glyceride oil and the amorphous silica is subjected to an increasing vacuum at substantially the same temperature for a time period of for instance 10 minutes to 2 hours, preferably 20 minutes to about 60 minutes.

The removal of water may be stopped when the water content of the oil is decreased to less than 0.3% w/w, preferably to less than 0.1% w/w.

Thereafter, the solids, generally amorphous silica loaded with impurities, is removed from the glyceride oil. Depending on the oil quality, it might be unnecessary to further refine the glyceride oil. However, if necessary, the refined oil may be subjected to a bleaching treatment using a bleaching agent, such as bleaching earth. An intermediate removal of the amorphous silica may be omitted and the bleaching earth may be added to the mixture comprising glyceride oil and amorphous silica. Subsequently, the bleaching agent is removed concomitantly with the amorphous silica when the solids are removed from the glyceride oil.

DETAILED DESCRIPTION OF THE INVENTION

Hereafter several embodiments of the refining process according to the invention will be given for illustrative purposes, but should not be construed as limiting the invention thereto.

EXAMPLE 1

Water degummed soybean oil (178 mg/kg P, 0.66% w/w ffa, 0.10% w/w $H_2O$) of 20° C. was mixed with an aqueous 0.7% w/w of a 50% w/w citric acid solution. The mixture was strongly stirred for 10 minutes and then slowly stirred for 20 minutes.

An aqueous 10% w/w sodium silicate solution (about 0.17% pure sodium silicate) was added to neutralize 70% of the added citric acid. The solution was strongly stirred for 5 minutes and then slowly stirred for 10 minutes. A sample was subtracted solids removed and the oil phase comprised 8.9 mg/kg P.

The oil was heated to 75° C. and 1.0% w/w Sorbsil R20 (obtained from Crosfield Chemicals) was added, followed by stirring for 30 minutes. Then the mixture was subjected to a vacuum of 700 mbar for 30 minutes, oil temperature 85° C. Subsequently, the solids were removed by filtration at an oil temperature of 85° C. The refined oil comprised less than 2 mg/kg P, 0.55% w/w ffa, whereas soaps were undetectable.

The refined oil was bleached by adding 0.5% w/w bleaching earth (Fulmont AA, obtained from Laporte Inorganics). The bleaching treatment lasted 15 minutes at 85° C. In comparison to the crude oil, the colour measured with a Lovibond 5.25 inch cell (Y+R+B) decreased from (30.0+10.9+0.7) to (20.0+7.1+0.0).

EXAMPLE 2

Example 1 was repeated using another water degummed soybean oil comprising 156 mg/kg P, 1.10% w/w ffa, and 0.04% w/w $H_2O$.

The starting temperature of the oil was 80° C. and decreased during the slow stirring after citric acid addition to 62° C.

After the partial neutralization using the aqueous sodium silicate solution, the phosphorous content of the oil phase was reduced to 17.9 mg/kg P.

Before bleaching, the phosphorous content of the refined oil was decreased to 2.0 mg/kg and after bleaching to less than 2 mg/kg.

Bleaching resulted in a colour reduction (5.25 inch cell, Y+R+B) of the crude oil (35.0+19.8+4.1) to (35.0+8.2+0.0).

EXAMPLE 3

Water degummed soybean oil (165 mg/kg P, 1.3 mg/kg Fe, 0.53% w/w ffa, and 0.08% w/w water) was intensively mixed with an aqueous 0.63% w/w citric acid solution (50% w/w) at ambient temperature (20° C.). After a residence time of 7 minutes, an aqueous sodium silicate solution (10% w/w) in an amount sufficient to neutralize 61% of the added citric acid (on a molar base) was added and intensively mixed. After a mean residence time of 85 minutes, the oil was heated to 85° C. Then, 0.825% w/w silica hydrogel (Trisyl, Davison Chemical Division of W. R. Grace & Co.) was added. After a contact time of 15 minutes, the mixture comprising soybean oil and silica hydrogel is subjected to vacuum. The pressure is gradually lowered from 600 mbar to finally 150 mbar, allowing a gentle drying of the oil.

In the table below, the decrease in phosphorous content and iron content during drying of the oil is summarized. The samples taken were microfiltrated (microfilter 0.22 micrometer) and the phosphorous and iron content were measured in the filtered oil.

TABLE 1

Phosphorous and iron content of the oil as function of the drying time and vacuum

| drying time (min) | vacuum (mbar) | $H_2O$ (% w/w) | P (mg/kg) | Fe (mg/kg) |
|---|---|---|---|---|
| 0 | — | 1.98 | 60 | 1.00 |
| 30 | 600 | 1.15 | 71 | 1.14 |
| 60 | 600 | 0.73 | 40 | 0.85 |
| 90 | 300 | 0.20 | 4 | 0.08 |
| 120 | 150 | 0.06 | 5 | 0.05 |

The refined oil comprised 0.59% w/w ffa.

I claim:

1. Method of refining glyceride oil, comprising the steps of:

i) acidifying the oil with an acid;

ii) partially neutralizing the acidified oil with alkali to less than 90% of the added acid;

iii) contacting the partially neutralized oil with an amorphous silica; and iv) removing solids from the glyceride oil.

2. Method as claimed in claim 1, wherein water is removed from the mixture comprising the glyceride oil and the amorphous silica.

3. Method as claimed in claim 1, wherein the acidified oil is neutralized with alkali for less than 80% of the added acid.

4. Method as claimed in claim 3, wherein about 50 to about 75% of the added acid is neutralized with alkali.

5. Method as claimed in claim 1, wherein the alkali is selected from the group comprising hydroxides and silicates.

6. Method as claimed in claim 5, wherein the alkali is sodium silicate.

7. Method as claimed in claim 1, wherein the alkali is added as an aqueous alkali solution.

8. Method as claimed in claim 7, wherein the alkali is added as an aqueous 5-20% w/w alkali solution.

9. Method as claimed in claim 1, wherein the oil temperature during acidification is less than 60° C.

10. Method as claimed in claim 9, wherein the oil temperature during acidification is about 5°-50° C.

11. Method as claimed in claim 1, wherein the oil temperature during the contact with the amorphous silica is above 70° C.

12. Method as claimed in claim 11, wherein the oil temperature during the contact with the amorphous silica is in the range of 80°-95° C.

13. Method as claimed in claim 1, wherein the amorphous silica is a silica hydrogel.

14. Method as claimed in claim 1, wherein the oil is slowly dried under vacuum.

15. Method as claimed in claim 14, wherein the drying time under vacuum is about 10 minutes to 2 hours.

16. Method as claimed in claim 14, wherein the vacuum is less than 700 mbar.

17. Method as claimed in claim 1, wherein the mil is dried to a water content of less than 0.3% w/w.

18. Method as claimed in claim 1, wherein the dried oil is bleached using a bleaching agent.

* * * * *